US007296453B1

(12) United States Patent
Oruganti et al.

(10) Patent No.: US 7,296,453 B1
(45) Date of Patent: Nov. 20, 2007

(54) METHOD OF FORMING A STRUCTURAL COMPONENT HAVING A NANO SIZED/SUB-MICRON HOMOGENEOUS GRAIN STRUCTURE

(75) Inventors: Ramkumar Kashyap Oruganti, Karnataka (IN); Pazhayannur Ramanathan Subramanian, Niskayuna, NY (US); Judson Sloan Marte, Wynantskill, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 11/285,853

(22) Filed: Nov. 22, 2005

(51) Int. Cl.
*B21C 23/00* (2006.01)

(52) U.S. Cl. ..... 72/253.1; 72/363

(58) Field of Classification Search ..... 72/39, 72/41, 42, 46, 47, 253.1, 257, 258, 270, 363
See application file for complete search history.

(56) References Cited

U.S. PATENT DOCUMENTS

| | | | | | |
|---|---|---|---|---|---|
| 1,948,242 | A * | 2/1934 | Schubarth | ..... | 72/258 |
| 3,335,589 | A * | 8/1967 | Buffet | ..... | 72/41 |
| 3,564,566 | A * | 2/1971 | Heitman | ..... | 29/423 |
| 3,580,019 | A * | 5/1971 | Beresnev et al. | ..... | 72/47 |
| 3,791,183 | A * | 2/1974 | Creuzet | ..... | 72/46 |
| 3,837,066 | A * | 9/1974 | Mori et al. | ..... | 29/599 |
| 4,116,030 | A * | 9/1978 | Kobayashi et al. | ..... | 72/40 |
| 5,400,633 | A | 3/1995 | Segal et al. | | |
| 6,865,920 | B2 * | 3/2005 | Kondo et al. | ..... | 72/273.5 |
| 2003/0118445 | A1 | 6/2003 | Lee et al. | | |

OTHER PUBLICATIONS

S. L., Semiatin et al., "Equal Channel Angular Extrusion of Difficult-To-Work Alloys", Materials and Design, vol. 21, pp. 311-322, 2000.

* cited by examiner

*Primary Examiner*—Ed Tolan
(74) *Attorney, Agent, or Firm*—Paul J. DiConza; William E. Powell, III

(57) ABSTRACT

A method of making nano/sub-micron sized grains in a work piece material having a lateral side has the steps of providing a die. The die has an entrance channel with a longitudinal axis and an exit channel. The entrance channel and the exit channel are connected to one another to form an angle. The method has the step of providing a first sacrificial material with a complementary size to the work piece and placing the sacrificial first material and the work piece in an entrance channel. The first sacrificial material and the work piece are aligned with the longitudinal axis. The method has the step of extruding the combination of the first sacrificial material, and the work piece through the intersection of the entrance and the exit channels. The resulting shear deformation forms the nano/sub-micron sized grains in the work piece. This configuration reduces frictional effects thereby producing homogenous nano grain structure. This configuration reduces applied load and enables equal channel angular extrusion of thin sheets.

23 Claims, 4 Drawing Sheets

66

66

METHOD OF FORMING A STRUCTURAL COMPONENT HAVING A NANO SIZED/SUB-MICRON HOMOGENEOUS GRAIN STRUCTURE

BACKGROUND

1. Technical Field

The present disclosure is directed to a fabrication process of a structural component. More particularly, the present disclosure is related to a fabrication process for a structural component to be used with high strength structural applications. Even more particularly, the present disclosure relates to a fabrication process for a structural component that results in a component having a homogeneous nano/sub-micron grain structure.

2. Description of the Related Art

High strength engineering components are known in the art. Plastic deformation has been used in the art to structurally alter and to enhance one or more physical properties of a work piece component for different metallic materials. One such known method entails using a die having a movable surface in a deformation channel of the die. The movable surface moves with a work piece material during a deformation process in the deformation channel. The billets have selected desired characteristics resulting from the deformation processing such as an improved strength and ductility. However, construction using such billets is expensive, due in part, because the billets or desired structural components can be formed only by using a very complex and cumbersome die structure. The complex die structure and components are expensive to use and make. They require additional expenses not only to form the die, but also to operate, and service the die for manufacturing a number of structural components or billets.

Moreover, such known dies have a detrimental operation and have die components that only minimize friction in one general direction or on the face of the work piece material. Such dies minimize friction in only a complementary location where a sliding die component moves. Such a reduction in friction may only provide a limited structural enhancement depending on the application. The friction on another side of the work piece material is relatively greater between the die component and the structural work piece component. This results in non-homogenous sized grains in the resulting structural component. This non-homogenous condition due to the increased friction on the one side relates to poor mechanical properties. This may lead to one or more unintended detriments depending on the structural application.

Thus, a need exists to develop a fabrication method which includes improved process steps that do not require an expensive die or die components to conduct the plastic deformation process. In addition, a need exists to develop a fabrication process that provides a homogenous sub-micron grain size across the cross section of the work piece component.

SUMMARY

According to a first aspect of the present disclosure, there is provided a method for processing a work piece having a front end, a back end, and a plurality of lateral sides. The method has the steps of providing a die having an entrance channel with a longitudinal axis and an exit channel. The entrance channel and the exit channel are connected to one another. The method has the step of placing the work piece in the entrance channel and disposing a first sacrificial material between the die and at least one lateral side of the work piece. The method also has the steps of extruding the first sacrificial material and the work piece material through the exit channel.

According to another aspect of the present disclosure, the method has the front end and the back end exposed and substantially free from contacting the first sacrificial material.

According to yet another aspect of the present disclosure, the method has all of the plurality of lateral sides in contact with the first sacrificial material.

According to still another aspect of the present disclosure, the method has first sacrificial material and the work piece with each being substantially orthogonal shaped members with a flat mating surface.

According to still yet another aspect of the present disclosure, the method has the work piece selected from the group consisting of nickel, a nickel alloy, a nickel base alloy, a nickel base alloy being strengthened by a precipitate, nickel base alloy being strengthened by a gamma prime precipitate or a nickel based super alloy, a co-base super alloy, an oxide dispersion strengthened alloy, a multi-layered combination of materials, an iron based alloy, and an aluminum based alloy, and titanium and titanium alloys.

According to another aspect of the present disclosure, the method has the first sacrificial material selected from the group consisting of carbon, graphite, aluminum, an aluminum alloy, copper, and a copper alloy.

According to still yet another aspect of the present disclosure, the method has sub-micron sized grains formed in the work piece. The grains are disposed in a substantially homogenous fashion throughout a cross section of the work piece.

According to yet another aspect of the present disclosure, the method has the first sacrificial material surrounding the work piece in a manner to reduce friction between the work piece during extrusion. The method also has the step of optionally repeating extrusion of the first sacrificial material and the work piece through the die.

According to another aspect of the present disclosure, the method has the first sacrificial material with substantially the same flow stress as the work piece.

According to another aspect of the present disclosure, the method has the first sacrificial material and the die have a first coefficient of friction at an interface therebetween. The first coefficient of friction is different relative to a second coefficient of friction being between a second interface between the die and the work piece.

According to another aspect of the present disclosure, the method has the sacrificial material and the work piece substantially filling the entrance channel.

According to another aspect of the present disclosure, the method has the first sacrificial material and the work piece substantially filling the exit channel.

According to another aspect of the present disclosure, the method has the first sacrificial material with a first vertical axis and the work piece having a second vertical axis. The first vertical axis and the second vertical axis form an angle. The angle is about zero.

According to another aspect of the present disclosure, there is provided a method for processing a work piece with a front end, a back end, and a plurality of lateral sides. The method has the step of providing a die with the die having an entrance channel and a longitudinal axis and an exit channel. The entrance channel and the exit channel are connected to one another, and the method also has the step of placing the work piece in the entrance channel with the step of disposing a first sacrificial material between the die and at least one lateral side of the work piece. The method further has the step of disposing a second sacrificial material between the die and at least one other lateral side of the work piece with the step of extruding the first sacrificial material, the second sacrificial material and the work piece through the die and through the exit channel.

According to another aspect of the present disclosure, the method has the first sacrificial material about the same size as the work piece.

According to another aspect of the present disclosure, the method has the second sacrificial material about the same size as the work piece.

According to still another aspect of the present disclosure, the method has the second sacrificial material and the first sacrificial material each with a flow stress. The flow stress is less than the flow stress of the work piece.

According to another aspect of the present disclosure, the method has the front end and the back end exposed and substantially free from contact with the first sacrificial material and the second sacrificial material.

According to another aspect of the present disclosure, the method has all of the lateral sides contacting either the first sacrificial material and the second sacrificial material.

According to another aspect of the present disclosure, the method has the step of imparting a clamping force perpendicular to the work piece to hold the work piece composite in the die.

According to another aspect of the present disclosure, the method further comprises the step of repeatedly extruding the first sacrificial material and the second sacrificial material with the work piece through the die.

According to another aspect of the present disclosure, there is provided an extrusion apparatus. The apparatus has a first "L" shaped die cavity forming an "L" shaped extrusion channel and a plurality of sacrificial materials in the extrusion channel. The apparatus also has the plurality of sacrificial materials contacting a first lateral side and a second lateral side of a work piece. The work piece also has a front side, and a rear side. The apparatus further has the plurality of sacrificial materials imparting a shear deformation on the first and the second lateral sides of the work piece material upon extrusion through the extrusion channel and the plurality of sacrificial materials leave the front side and the rear side exposed.

BRIEF DESCRIPTION OF THE FIGURES

Various embodiments will be described herein below with reference to the drawings wherein.

DETAILED DESCRIPTION OF THE EMBODIMENTS

Figure 1:
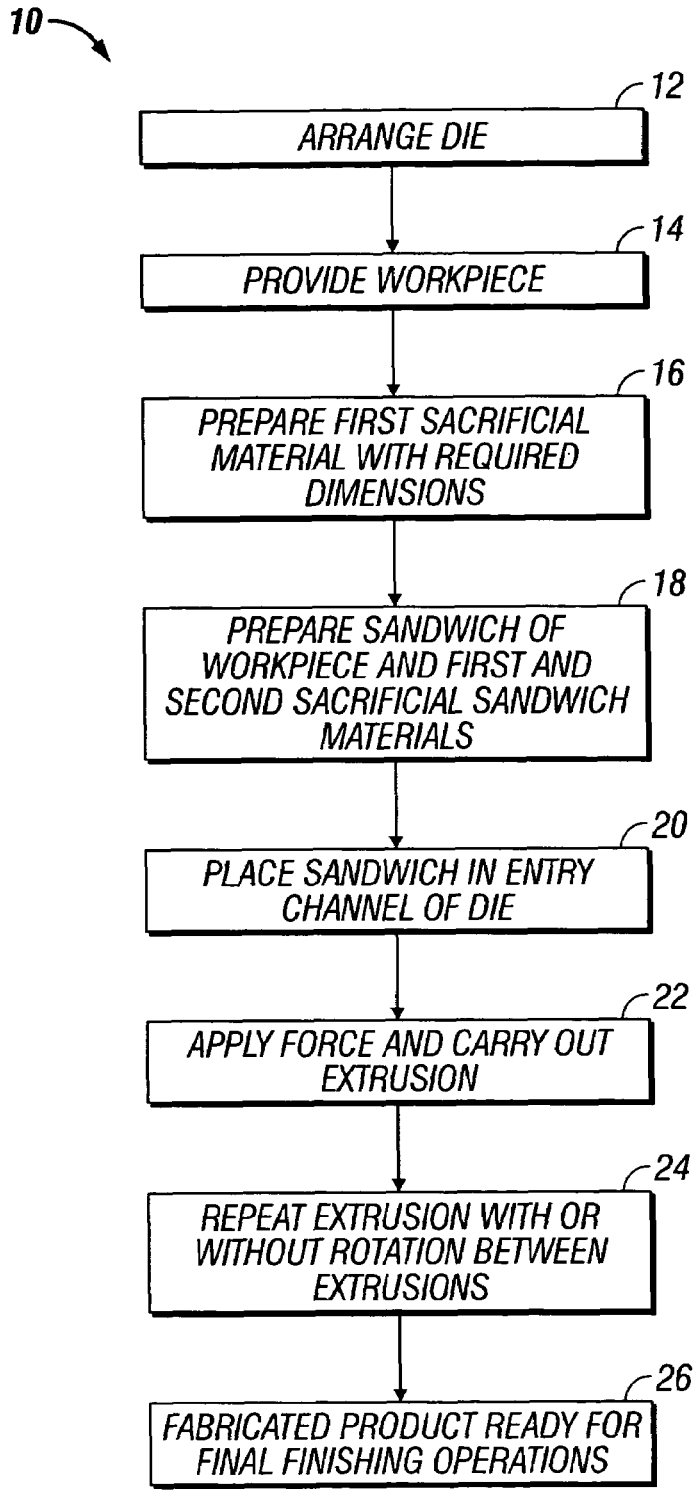
FIG. 1 is a flow chart of the fabrication process according to the present disclosure.

Reference should be made to the drawings where like reference numerals refer to similar elements throughout the various figures. The fabrication process of the present disclosure controls a microstructure of a work piece material resulting from a deformation of the work piece material. The fabrication process uses a first sacrificial material and, in some embodiments, a second sacrificial material, to reduce friction between a die and the work piece, and thus form a homogenous nano/sub micron sized grains in the work piece material or work piece.

Referring now to FIG. 1, there is shown a process flow chart of the fabrication method 10 of the present disclosure. The method 10 has the first step 12 of arranging the die. Thereafter, the method proceeds to step 14. At step 14, the method has the step of providing a work piece in the die. The work piece is defined as the material that will undergo the plastic deformation in order to result in a controlled microstructure. Thereafter, the method proceeds to step 16. At step 16, a first sacrificial material is prepared. The first sacrificial material has dimensions that are complementary to the dimensions of the work piece material. The first sacrificial material moves with the work piece material during a shear process and thus reduces friction and contact between the work piece material and the die. Thereafter, the method proceeds to step 18.

At step 18, for those embodiments employing a second sacrificial material, the second sacrificial material is prepared. The second sacrificial material has dimensions that are also complementary to the dimensions of the work piece material and the first sacrificial material. Likewise, the second sacrificial material moves with the work piece material during the shear process and thus reduces friction between the work piece material and the die. The second sacrificial material is placed on an opposite side of the work piece material so that the first sacrificial material and the second sacrificial material are opposite one another with the work piece material between both the first sacrificial material and the second sacrificial material to form a composite or sandwich. Thereafter, the method proceeds to step 20.

At step 20, the first sacrificial material and the second sacrificial material (if used) opposite the first sacrificial material with the work piece material disposed therebetween are all placed in an entrance channel of the die. Thereafter, the method proceeds to step 22. At step 22, a suitable force is applied to the combined first sacrificial material/work piece material and second sacrificial material to extrude the composite billet through the die. Thereafter, the method proceeds to step 24. At step 24, the extrusion step may be optionally repeated. One should appreciate the method may advantageously be conducted with a single pass through the die, and the method is not limited to any multiple passes through the die. Notwithstanding, the extrusion step may be optionally repeated with a 180 degree rotation of the combined first sacrificial material/work piece material and second sacrificial material. Thereafter, the method proceeds to step 26. At step 26, the resulting work piece material having homogenous and uniform sub-micron grains is removed from the first and the second sacrificial materials and is ready for a final finishing operation to make the work piece material ready for the relevant high strength application. One such application may be an airfoil or a turbine blade. Various finished product configurations are possible.

Figure 2:
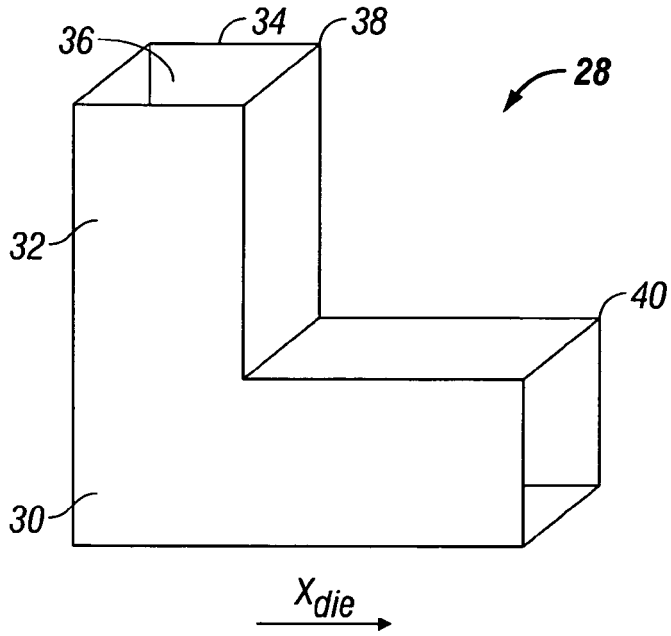
FIG. 2 is a schematic diagram of a die having a first extrusion channel and a second extrusion channel according to the present fabrication process.

Referring to FIG. 2, there is shown a schematic diagram of one embodiment of the presently disclosed system 28 with a die 30 for forming a number of sub-micron sized grains in the work piece material. "Submicron" sized or "nano sized" grains means that the resulting deformation process forms grains in a range of size that includes below a millionth of a meter. This process is called equal channel angular extrusion. By decreasing a grain size of the work piece material, an increase in strength of the material will result. A microstructure with nano or sub-micron sized grains results from the deformation processing. The nano sized grains and the homogeneous arrangement of the nano sized grains enhance one or more mechanical properties of the work piece material resulting from the deformation. The resulting work piece material having increased strength can then be used in any number of applications, such a turbine application, a turbine blade application, a compressor application, a compressor blade application, a nuclear application, a combustor application, a fan compressor application, an airfoil application, an air inlet application, or an air or gas exhaust application, a transportation or aerospace application, a rotary rotational movement application, or any other number of applications that require a structural component with a controlled microstructure and high strength or improved ductility.

The die 30 has a first die component 32 and a second die component 34 with a die cavity 36 disposed between the first die component 32 and the second die component 34. The first die component 32 and the second die component 34 each are made from a tool steel, or another suitable high strength suitable material, or alloy. The die 30 is made from a suitable material that will maintain integrity during an extrusion process. The first die component 32 and the second die component 34 are form substantially an "L" shaped die cavity 36.

The die 30 also has other assemblies in order to clamp and connect the first die component 32 to the second die component 34 with another material therein disposed therebetween. The die 30 further has an entrance channel 38 and an opposite exit channel 40. Each of the entrance channel 38 and the exit channel 40 are generally orthogonal shaped and communicate with the die cavity 36. In another embodiment, the entrance channel 38 and the exit channel 40 may have different shapes or configurations relative to one another such as a circular configuration.

Figure 3:
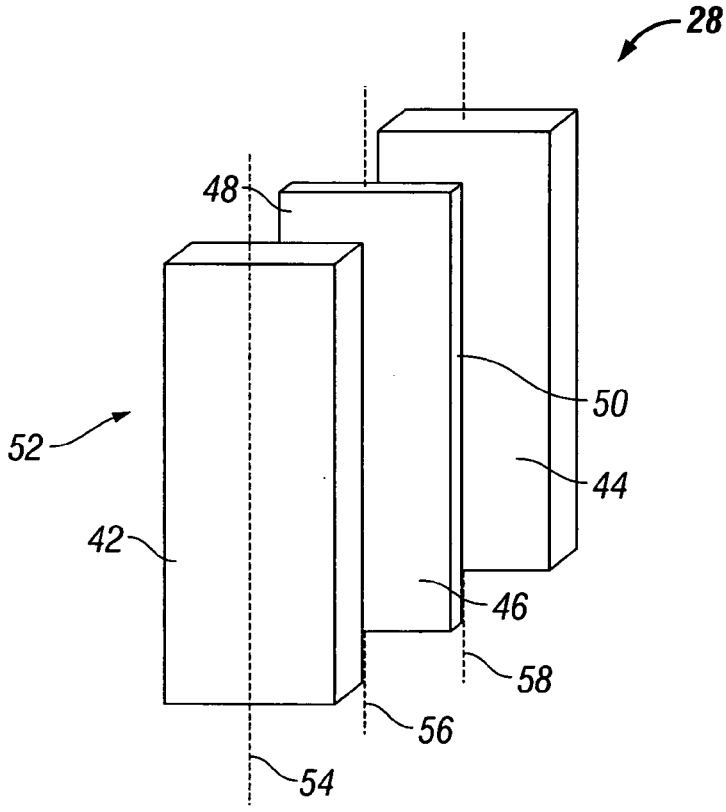
FIG. 3 is a schematic diagram of a work piece material placed between a first sacrificial material and a second sacrificial material.

Referring now to FIG. 3, the system 28 further has a first sacrificial material 42 and a second sacrificial material 44. The first and the second sacrificial materials 42, 44 are generally orthogonal or rectangular members each made of the same or a different material. In this embodiment, the first and the second sacrificial materials 42, 44 each have a substantially flat outer surface. The term "sacrificial" means that the material of this element of the present disclosure is intended not to form any of the finished final structurally enhanced products, and is intended to be discarded.

The system 28 further has a work piece 46. The work piece 46 is a member in which the nano/sub micron sized grains are to be formed, and that is to be used as the high strength component as discussed previously. The work piece 46 is generally an orthogonal shaped or a rectangular member. In another embodiment, the work piece 46 may have any desired shape as long as the sacrificial materials 42, 44 have the complementary shape to accommodate the work piece 46. In this embodiment, the work piece 46 has a substantially flat outer surface. The work piece 46 may be nickel, a nickel alloy, a nickel base alloy, a nickel base alloy being strengthened by a precipitate, nickel base alloy being strengthened by a gamma prime precipitate or a nickel based super alloy, a co-base super alloy, an oxide dispersion strengthened alloy, a multi-layered combination of materials or a composite, an iron based alloy, and an aluminum based alloy, and titanium and titanium alloys or a suitable combination of materials. The sacrificial materials have a flow stress less than or equal to the flow stress of the work piece 46. The flow stress is the stress required to cause a plastic deformation in metallic materials. If the flow stress of the sacrificial materials 42, 44 is low, the overall applied force required to deform the system is lowered. This places less demanding requirements on the press used for extrusion. Pure aluminum, as one non-limiting exemplary example, has a range of flow stress from 2 to 70 Megapascals (hereinafter "MPa") depending on temperature, strain rate and strain. Work pieces 46 will usually be relatively much higher or as much as 1,000 Mpa.

The first sacrificial material 42 and the second sacrificial material 44 are both disposed to surround the work piece 46 so as to move with the work piece 46 during an extrusion process through the die cavity 36 of FIG. 2. The first sacrificial material 42 is disposed on a first lateral side 48 of the work piece 46 and the second sacrificial material 44 is disposed on an opposite or second lateral side 50. The first sacrificial material 42 is disposed substantially parallel to the work piece 46 on the first lateral side 48 so an angle therebetween is about zero. The second sacrificial material 44 is also likewise disposed substantially parallel to the work piece 46 on the opposite side 50 of the first sacrificial material 42 so an angle therebetween is about zero. Each of the first sacrificial material 42 and the second sacrificial material 44 has a similar and complementary configuration relative to one another. Additionally, each, in another embodiment, may have the same material having the same size and shape. In one embodiment, each is a substantially rectangular shaped member. The first sacrificial material 42 may be aluminum, an aluminum alloy, a copper, a copper alloy, a combination thereof, or any material with a relatively low flow stress. Likewise the second sacrificial material 44 may be the same or different than the first sacrificial material 42 and may be aluminum, an aluminum alloy, a copper, a copper alloy, a combination thereof, or any material with a low flow stress. The first and the second sacrificial materials 42, 44 instead each have flow properties or characteristics that allow the first and the second sacrificial materials 42, 44 to flow with the work piece 46 in a manner such that the work piece 46 experiences less friction between the work piece 46 and the die cavity 36 during extrusion. The first and the second sacrificial materials 42, 44 are intended to prevent the work piece 46 from contacting some of the inner surfaces of the die 30. This prevents friction forces arising from any contact with the die 30 thereby potentially causing a non-homogenous grain size in the work piece 46 during the severe plastic deformation in the die 30 during extrusion. The first and the second sacrificial materials 42, 44 with low flow stress, also serve the purpose of reducing overall loads to effect extrusion. Moreover, the first and the second sacrificial materials 42, 44 also enable extrusion of thin sheets of work pieces 46.

Figure 4:
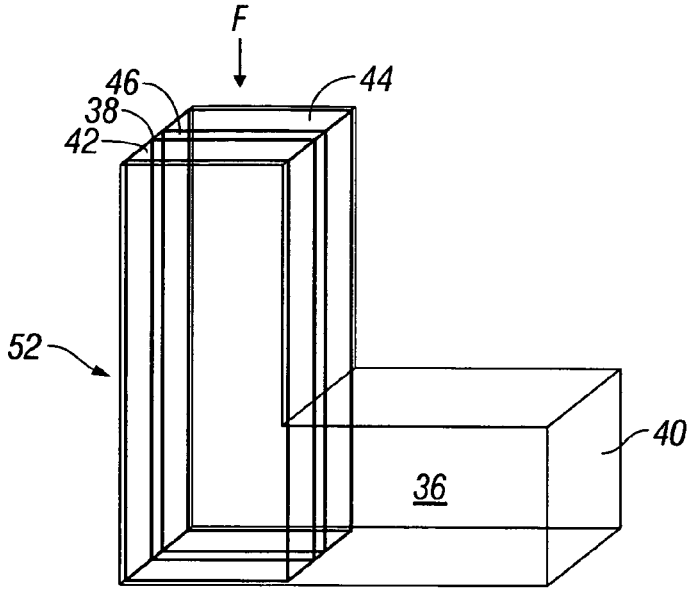
FIG. 4 is another schematic view of the die of FIG. 2 with the work piece material of FIG. 3 in the die and between the first sacrificial material and the second sacrificial material.

Referring now to FIG. 3, there is shown a perspective view of the first sacrificial material 42, and the second sacrificial material 44 with the work piece 46 placed therebetween. As shown, each of the first sacrificial material 42 and the second sacrificial material 44 with the work piece 46 forms an unconnected composite structure collectively indicated by reference numeral 52. Referring now to FIG. 4, the composite 52 or sandwich is placed in the die 30. One aspect of the present disclosure is that the first sacrificial material 42 has a first vertical axis 54 and the work piece 46 also has a second vertical axis 56. The angle between the first vertical axis 54 and the second vertical 56 axis is zero when the first sacrificial material 42 is placed adjacent to the work piece 46 as shown in FIG. 3.

Likewise, the second sacrificial material 44 has a third vertical axis 58. The angle between the third vertical axis 58 and the second vertical axis 56 of the work piece 46 is also zero when the second sacrificial material 44 is placed adjacent to the work piece 46 as shown in FIG. 3. A suitable lubricant is then applied to one or more inner surfaces of the die cavity 36 as shown in FIG. 4. Various lubricants or lubricating configurations are possible and are within the scope of the present disclosure. The composite 52 then undergoes a severe plastic deformation by an Equal Channel Angular Extrusion using the die 30, where the composite 52 is extruded from the entrance channel 38 through the exit channel 40 by Force F as illustrated by the reference arrow. The Equal Channel Angular Extrusion operation results in the work piece 46 during the extrusion undergoing an intense shear deformation by passage through the die cavity 36. This leads to a refinement of the microstructure of the work piece 46 of the composite 52 or sandwich. The extrusion process can be performed using a suitable hydraulic pressing apparatus introduced into the entrance channel 36 of the die 30. Various extrusion apparatus configurations or pressing apparatuses such as ECA pressing are possible and all are within the scope of the present disclosure.

Figure 5:
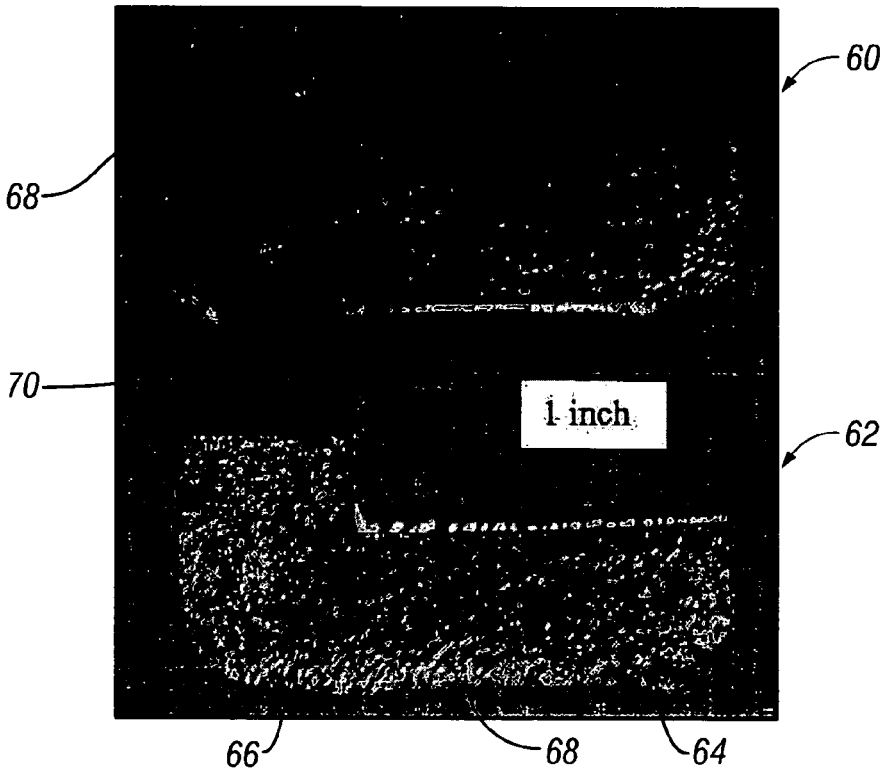
FIG. 5 is a lateral side view of a first sacrificial material made from aluminum and the work piece material made from nickel after being extruded.
Figure 7:
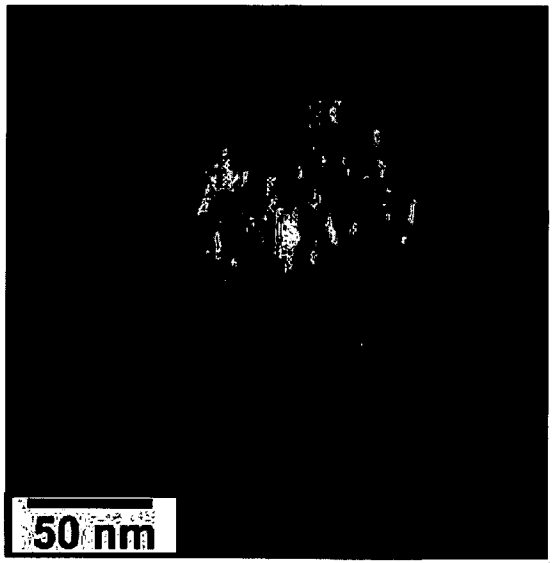
FIG. 7 is another view of the nano/sub-micron grains of the work piece material at 50 nm.
Figure 6:
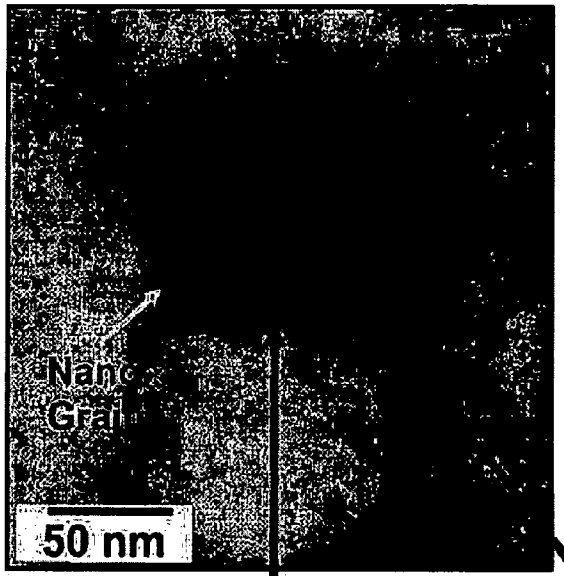
FIG. 6 is a view of the nano/sub-micron grains of the work piece material at 50 nm.
Figure 9:
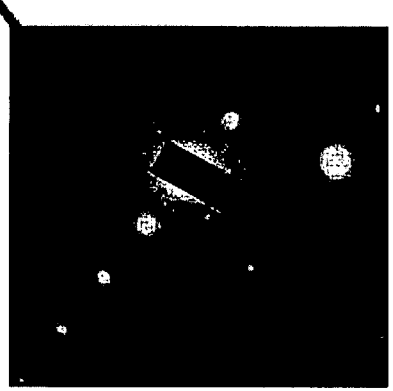
FIG. 9 is another view of the nano/sub-micron grains of the work piece material at about 122 nm.
Figure 8:
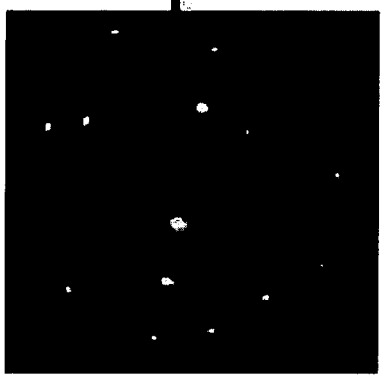
FIG. 8 is a view of the nano/sub-micron grains of the work piece material at 110 nm.

Referring now to FIG. 5 there is shown a perspective view of an aluminum first sacrificial material 60 and a work piece 62 using an aluminum second sacrificial material and a nickel work piece. As can be seen by the figure, the nickel work piece has undulations 66 on a first lateral side 64 that are indicative of a shearing process. The undulations 66 indicate that the first lateral side 64 saw substantially no friction from the die cavity 36 or die component and a homogenous amount of undulations are present. The undulations 66 are present along substantially the entire lateral side 64 and are only absent only a slight proximal distance from a top surface 68 and a bottom surface 70. This indicates that the friction from the first die component 32 is confined to the top and the bottom surfaces 68, 70. Referring now to FIGS. 6 and 7, there is shown a microscopic view of the nickel work piece 62 of FIG. 5. Diffraction patterns corresponding to FIG. 6 are shown in FIGS. 8 and 9. Straight arrows connect the diffraction patterns to the areas from where they were obtained. The diffraction pattern from the central dark region in FIG. 6 corresponds to a zone axis close to about 110. The diffraction pattern from the area surrounding the central dark area region in FIG. 6 corresponds to a zone axis close to about 122. These two zone axes are at an angle of about forty five degrees. Hence, the central dark area in FIG. 6 is definitely a nano-grain. The nano-grain has a dimension of about 60 nanometers.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variances. The embodiments described with reference to the attached drawing figures are presented only to demonstrate certain examples of the disclosure. Other elements, steps, methods and techniques that are insubstantially different from those described above and/or in the appended claims are also intended to be within the scope of the disclosure.

What is claimed is:

1. A method for processing a work piece having a front end, a back end, and a plurality of lateral sides, the method comprising:

providing a die, said die having an entrance channel with a longitudinal axis and an exit channel, said entrance channel and said exit channel being connected to one another;

disposing a first sacrificial material between said die and at least one lateral side of the work piece while leaving the front end and back end substantially free from contacting said first sacrificial material; and extruding said first sacrificial material and said work piece through said exit channel.

2. The method of claim 1, wherein all of the plurality of lateral sides are in contact with said first sacrificial material.

3. The method of claim 1, wherein said first sacrificial material and the work piece are each substantially orthogonal shaped members having a flat mating surface.

4. The method of claim 1, wherein the work piece is selected from the group consisting of nickel, a nickel alloy, a nickel base alloy, a nickel base alloy being strengthened by a precipitate, nickel base alloy being strengthened by a gamma prime precipitate, a nickel based super alloy, a co-base super alloy, an oxide dispersion strengthened alloy, a multi-layered combination of materials, an iron based alloy, and an aluminum based alloy, a titanium, a titanium alloy, and any combination thereof.

5. The method of claim 1, wherein said first sacrificial material is selected from the group consisting of carbon, graphite, aluminum, an aluminum alloy, a copper, and a copper alloy.

6. The method of claim 1, wherein sub-micron sized grains are formed in the work piece and are disposed in a substantially homogenous fashion throughout a cross section of the work piece.

7. The method of claim 1, wherein said first sacrificial material surrounds the work piece in a manner to reduce friction between the work piece during extrusion, and further comprising the step of optionally repeating extrusion of said first sacrificial material and the work piece through said die.

8. The method of claim 1, wherein said first sacrificial material has the same flow stress as the work piece.

9. The method of claim 1, wherein said first sacrificial material and said die have a first coefficient of friction at an interface therebetween, said first coefficient of friction being different relative to a second coefficient of friction being between a second interface between said die and the work piece.

10. The method of claim 1, wherein said first sacrificial material and the work piece substantially fill said entrance channel.

11. The method of claim 1, wherein said first sacrificial material and the work piece substantially fill said exit channel.

12. The method of claim 1, wherein the first sacrificial material has a first vertical axis and the work piece has a second vertical axis, wherein the first vertical axis and the second vertical axis form an angle, said angle being about zero.

13. The method of claim 1, wherein all of said plurality of lateral sides contact either said first sacrificial material and said second sacrificial material.

14. A method for processing a work piece having a front end, a back end, and a plurality of lateral sides, the method comprising:

providing a die, said die having an entrance channel with a longitudinal axis and an exit channel, said entrance channel and said exit channel being connected to one another;

disposing a first sacrificial material between said die and at least one lateral side of the work piece while leaving said front end and said back end substantially free from contact with said first sacrificial material;

disposing a second sacrificial material between said die and at least one other lateral side of the work piece while leaving said front end and said back end substantially free from contact with said second sacrificial material;

extruding said first sacrificial material, said second sacrificial material and said work piece through said die and through the exit channel.

15. The method of claim 14, wherein said first sacrificial material is about the same size as the work piece.

16. The method of claim 14, wherein said second sacrificial material is about the same size as the work piece.

17. The method of claim 14, wherein said second sacrificial material and said first sacrificial material each have a flow stress, said flow stress being less than another flow stress of the work piece.

18. The method of claim 14, further comprising the step of repeatedly extruding said first sacrificial material and said second sacrificial material with the work piece through said die.

19. The method of claim 14, wherein the work piece is selected from the group consisting of nickel, a nickel alloy, a nickel base alloy, a nickel base alloy being strengthened by a precipitate, nickel base alloy being strengthened by a gamma prime precipitate, a nickel based super alloy, a co-base super alloy, an oxide dispersion strengthened alloy, a multi-layered combination of materials, an iron based alloy, and an aluminum based alloy, a titanium, a titanium alloy, and any combination thereof.

20. The method of claim 14, wherein said first sacrificial material is selected form the group consisting of graphite, carbon, aluminum, an aluminum alloy, a copper, a copper alloy, and any combination thereof, and wherein said second sacrificial material is selected from the group consisting of aluminum, an aluminum alloy, a copper, and a copper alloy.

21. The method of claim 14, wherein said second sacrificial material and said first sacrificial material each have a flow stress, said flow stress being about the same as another flow stress of the work piece.

22. An extrusion apparatus comprising:

a die cavity forming an "L" shaped extrusion channel; and a plurality of sacrificial materials in said extrusion channel;

wherein said plurality of sacrificial materials contact a first lateral side and a second lateral side of a work piece, wherein said work piece has a front side, and a rear side;

wherein said plurality of sacrificial materials impart a shear deformation on said first and said second lateral sides of the work piece upon extrusion through said extrusion channel;

wherein said plurality of sacrificial materials leave said front side and said rear side exposed; and wherein said plurality of sacrificial materials have a flow stress required to cause a plastic deformation, said flow stress being less than a second flow stress of the work piece.

23. The apparatus of claim 22, wherein said plurality of sacrificial materials have a flow stress required to cause a plastic deformation, said flow stress about the same as a second flow stress of the work piece.

* * * * *